US005289712A

United States Patent [19]

Haughian

[11] Patent Number: 5,289,712

[45] Date of Patent: Mar. 1, 1994

[54] QUICK-ACTION CRIMPING TOOL

[75] Inventor: Daniel J. Haughian, Mission, Canada

[73] Assignee: Haughian Sales Ltd., Mission, Canada

[21] Appl. No.: 8,711

[22] Filed: Jan. 25, 1993

[51] Int. Cl.[5] ..... B21D 39/04

[52] U.S. Cl. ..... 72/410; 81/302; 81/383.5; 29/237

[58] Field of Search ..... 72/410, 409; 81/302, 81/381, 383.5; 29/751, 237, 268, 270

[56] References Cited

U.S. PATENT DOCUMENTS

| | | | |
|---|---|---|---|
| 354,657 | 12/1886 | Rowe | 72/409 |
| 1,485,489 | 3/1924 | Dockery | 81/381 |
| 2,339,880 | 1/1944 | Romanoff | 81/383.5 |
| 2,899,852 | 8/1959 | Burgess | 72/409 |
| 3,411,339 | 11/1968 | Brown | 72/409 |
| 4,221,048 | 9/1980 | Parramore | 72/410 |
| 4,237,718 | 12/1980 | Greenwood | 72/410 |
| 5,121,624 | 6/1992 | Haughian | 72/410 |

FOREIGN PATENT DOCUMENTS

| | | | |
|---|---|---|---|
| 515919 | 9/1954 | Belgium | 72/409 |
| 463670 | 3/1950 | Canada | 72/410 |
| 226742 | 10/1910 | Fed. Rep. of Germany | 72/409 |
| 192635 | 11/1983 | Japan | 72/410 |

*Primary Examiner*—Daniel C. Crane

[57] ABSTRACT

This invention is directed to a novel quick action crimping tool. More particularly, this invention pertains to a novel high leverage tool which can be used to crimp metal rings onto piping joints. A quick-action crimping tool comprising: (a) a first jaw means with a portion of a crimp opening in a side thereof adjacent a second jaw means; (b) a second jaw means with a portion of a crimp opening in a side thereof adjacent the first jaw means; (c) a jaw constraint arm means, the first jaw means being rigidly connected to the jaw constraint arm means, the second jaw being pivotally connected to the jaw constraint arm means; and (d) a leverage arm means pivotally connected to the jaw constraint arm means and during pivotal movement relative to the jaw constraint arm means reciprocally moves the second jaw means between an open position and a closed position relative to the first jaw means.

12 Claims, 3 Drawing Sheets

QUICK-ACTION CRIMPING TOOL

FIELD OF THE INVENTION

This invention is directed to a novel quick-action crimping tool. More particularly, this invention pertains to a novel high leverage tool which can be used to crimp metal rings onto piping joints.

BACKGROUND OF THE INVENTION

U.S. Pat. No. 5,121,624, Haughian, is directed to a novel pipe ring crimping tool which is adapted for crimping a ring over plastic plumbing pipe onto a fitting. The crimping tool comprises a first jaw component constructed to have a concave semi-cylindrical opening on one side, and at a first end, an elongated protrusion adapted for receiving an arm, and at the second end, part of a hinge member; a second jaw component constructed to have a concave semi-cylindrical opening on one side, and at a first end, an elongated protrusion adapted for receiving an arm, and at the second end, part of a hinge member; a connecting link member adapted to connect together in a pivotal manner the second end of the first component removed from the protrusion and the second end of the second component removed from the protrusion; an elongated bar adapted to removably fit over the protrusion of the first component; and a second elongated bar adapted to removably fit over the end of the protrusion of the second component.

Said crimping tool requires four separate actions in order to crimp a ring onto a pipe joint. The tool is first placed over the ring, the ring is then crimped tight, the tool is then opened, and finally the tool is removed. Sometimes, it is awkward in confined conditions for the user to efficiently place the tool over the pipe and to apply enough compressive force to the handles to crimp the ring properly. In such conditions, a greater mechanical leverage would be helpful.

SUMMARY OF THE INVENTION

The invention is directed to a quick-action crimping tool comprising: (a) a first jaw means with a portion of a crimp opening in a side thereof adjacent a second jaw means; (b) a second jaw means with a portion of a crimp opening in a side thereof adjacent the first jaw means; (c) a jaw constraint arm means, the first jaw means being rigidly connected to the jaw constraint arm means, the second jaw being pivotally connected to the jaw constraint arm means; and (d) a leverage arm means pivotally connected to the jaw constraint arm means and during pivotal movement relative to the jaw constraint arm means reciprocally moving the second jaw means between an open position and a closed position relative to the first jaw means.

In the tool as described, the leverage arm means can have thereon a wheel which contacts the second jaw means and moves it as the leverage arm means is pivotally moved. The first jaw means can be attached to one end of the jaw constraint arm means and an extension handle can be removably attached to the opposite end of the jaw constraint arm means.

An extension handle can be removably attached to an end of the leverage arm means removed from the end of the leverage arm means which moves the second jaw means. The jaw constraint arm means can be pivotally connected to the leverage arm means by a pin and bushing. The second jaw means can be pivotally connected to the jaw constraint means by a pin and bushing. The wheel can be connected to the end of the leverage arm means by a pin and bushing.

The second jaw means can have a stop which prevents the leverage arm means from moving beyond a certain point. The leverage arm means can have a stop which prevents the leverage arm means and the jaw constraint arm means from pivoting beyond a certain point relative to each other.

A side of the second jaw means can be contacted by the leverage means, the side of the second jaw means being curved so that reciprocal movement of the leverage arm means between two positions opens or closes the second jaw means relative to the first jaw means.

BRIEF DESCRIPTION OF THE DRAWINGS

In drawings which illustrate specific embodiments of the invention, but which should not be construed as restricting the spirit or scope of the invention in any way.

DETAILED DESCRIPTION OF A SPECIFIC EMBODIMENT OF THE INVENTION

Figure 1:
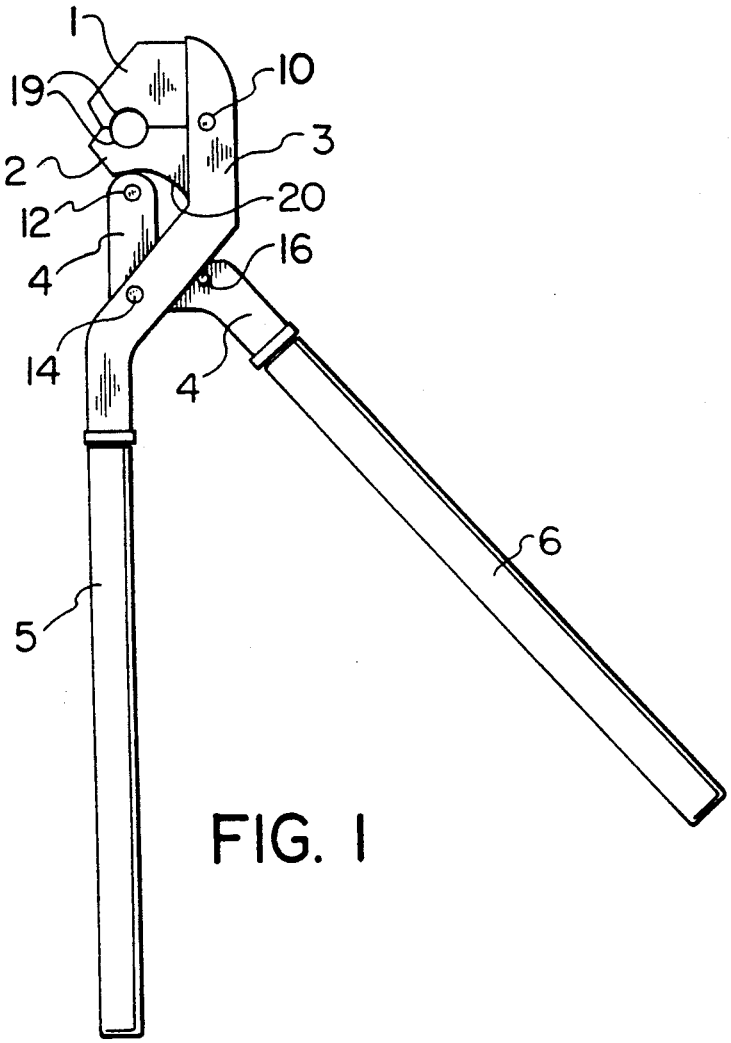
FIG. 1 illustrates a front view of the quick-action crimping tool in closed position, with the handles spread.
Figure 2:
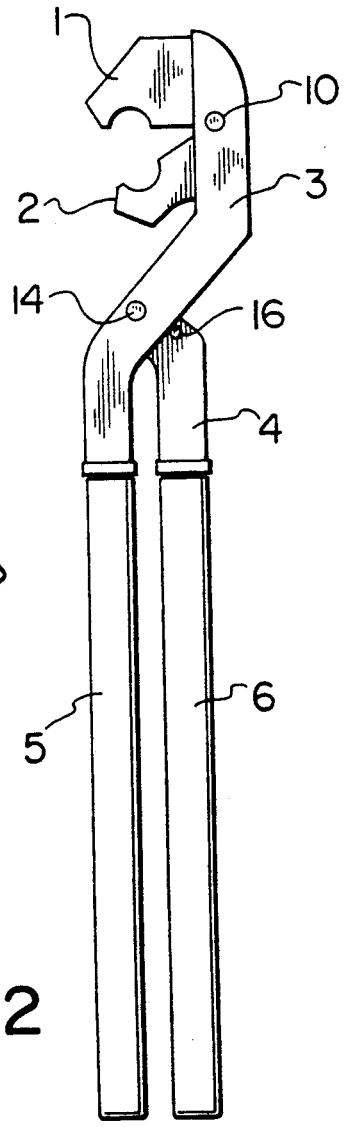
FIG. 2 illustrates a front view of the quick-action crimping tool in open position, with the handles together.

Referring to the drawings, FIG. 1 illustrates a front view of the quick-action crimping tool in closed position, with the handles spread, while FIG. 2 illustrates a front view of the quick-action crimping tool in open position with the handles together. Specifically, the quick action crimping tool is constructed of an upper crimp jaw 1 and a lower crimp jaw 2, which pivotally moves towards and away from the upper crimp jaw 1 to create respective closed and open positions. The upper crimp jaw 1 is rigidly connected to jaw constraint arm 3. The lower crimp jaw 2 is pivotally connected to jaw constraint arm 3 by fulcrum pin 10. A removable extension handle 5 is detachably connected to the end of jaw constraint arm 3. A similar removable extension handle 6 is detachably connected to leverage arm 4.

The crimping tool has several related actions of movement. Lower crimp jaw 2 pivots upwardly or downwardly about fulcrum pin 10 in jaw constraint arm 3. Leverage arm 4 pivots relative to jaw constraint arm 3 about swivel pin 14. The underside of upper crimp jaw 1 and the top side of lower crimp jaw 2 each have a semi-circular opening 19, which when closed together forms a circle. The two openings 19 fit over a crimp ring (not shown) and when the extension handles 5 and 6 are pushed together (FIG. 2), causes the jaws 1 and 2 to close together and thus exert a force on the ring to crimp it about the tube or piping (not shown).

The upper end of leverage arm 4 has a leverage arm wheel 13 (not shown in FIG. 1 but see FIG. 3) which rotates about pin 12 and bears against the curved under surface 20 of lower crimp jaw 2. The wheel 13 reduces friction between leverage arm 4 and surface 20 and eases reciprocal movement from closed to open positions, and vice versa. The curved under surface 20 is carefully designed so that the jaws 1 and 2 are closed when leverage arm 4 is at one end of the travel path of the curved surface 20, arms 5 and 6 are apart (FIG. 1), and the jaws 1 and 2 are open when it is at the other end of the travel path of the curved surface 20, and arms 5 and 6 are together (FIG. 2). The maximum open position for the arms 5 and 6 is determined by stop 16. The maximum open position of the jaws 1 and 2 is determined by stop 21 on lower crimp jaw 2 (see FIG. 3).

Figures 3, 4, 5, 6, 7, 8, 9:
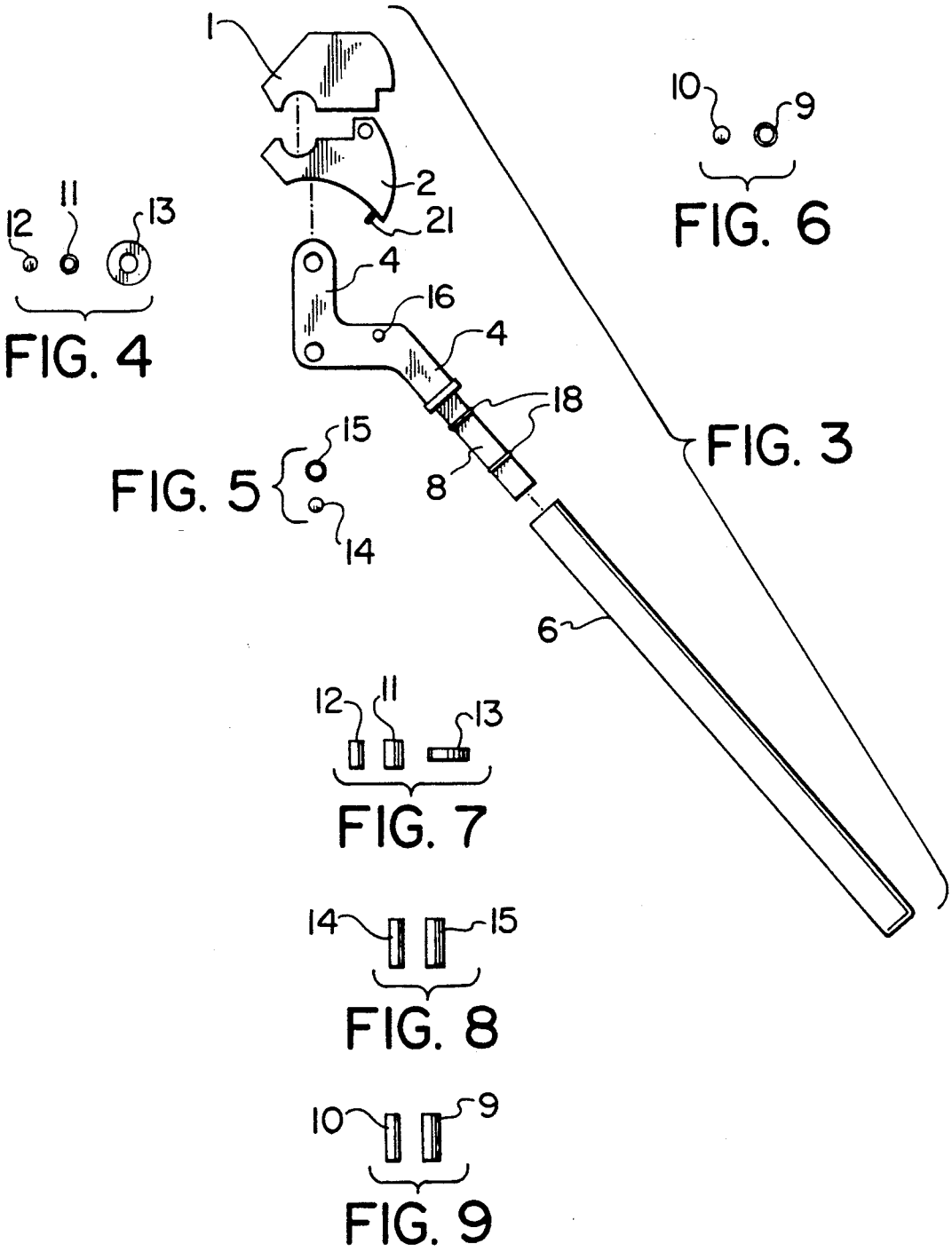
FIG. 3 illustrates an exploded view of the leverage arm and the jaw components of the quick-action crimping tool.
FIG. 4 illustrates a front view of the bushing, pin and wheel of the leverage arm wheel.
FIG. 5 illustrates a front view of the bushing and pin of the swivel.
FIG. 6 illustrates a front view of the bushing and pin of the fulcrum.
FIG. 7 illustrates a top view of the bushing, pin and wheel of the leverage arm wheel.
FIG. 8 illustrates a top view of the bushing and pin of the swivel.
FIG. 9 illustrates a top view of the bushing and pin of the fulcrum.

FIG. 3 illustrates an exploded view of the leverage arm and the jaw components of the quick-action crimping tool. The hollow handle 6 is removably attachable to leverage arm extension 8 which has a pair of spaced apart rubber 0-rings 18 around its circumference. These O-rings 18 enable ready connection and disconnection, and help to hold the handle 6 over the extension 8 when the two are together.

FIG. 4 illustrates a front view of the bushing 11, pin 12 and wheel 13 of the leverage arm wheel. FIG. 5 illustrates a front view of the bushing and pin 14 of the swivel. FIG. 6 illustrates a front view of the bushing and pin 10 of the fulcrum. The bushings 11, 15 and 9 reduce friction between the moving parts and thereby enable most of the force exerted on the handles to be transmitted to the crimping action. These parts also prolong the life of the tool by reducing wear. Thus the tool does not become "sloppy" with use and continues to provide a sharp crimping action.

FIG. 7 illustrates a top view of the bushing 11, pin 12 and wheel 13 of the leverage arm wheel. FIG. 8 illustrates a top view of the bushing 15 and pin 14 of the swivel. FIG. 9 illustrates a top view of the bushing 9 and pin 10 of the fulcrum. Again, these bushings reduce wear and friction, prolong the life of the tool and ensure snug easy working fits and moving surfaces.

Figure 10:
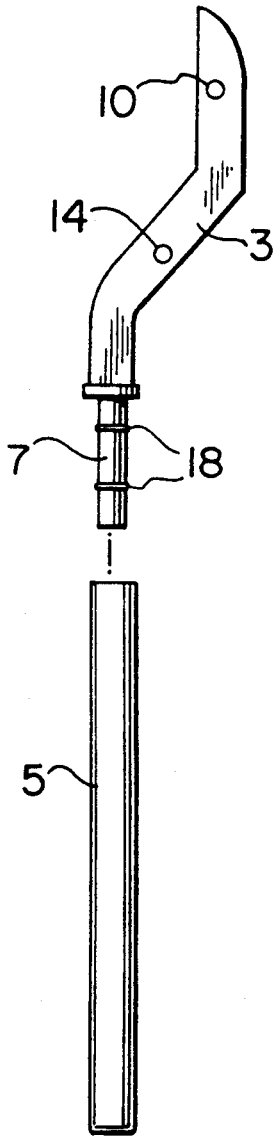
FIG. 10 illustrates a front view of the jaw constraint arm.
Figure 11:
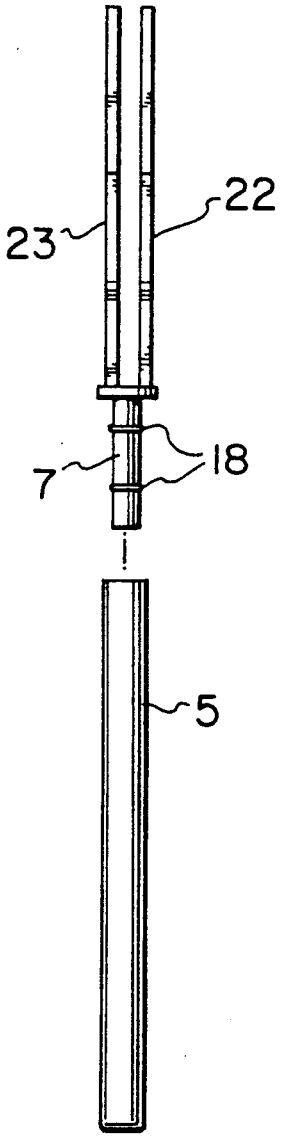
FIG. 11 illustrates an end view of the jaw constraint arm.

FIG. 10 illustrates a front view of the jaw constraint arm 3. The jaw constraint arm 3, at its lower end, has an arm extension 7, to which the removable hollow extension handle 5 can be attached. The extension 7 has a pair of spaced rubber 0-rings 18 around its circumference. FIG. 11 illustrates an end view of the jaw constraint arm. As seen in FIG. 11, the upper end of jaw constraint arm 3 has two arms 22 and 23, which form a space between them. This space is designed to accommodate the upper jaw 1, the lower jaw 2 and the leverage arm 4 and wheel 13 when the handle 6 and leverage arm 4 are moved to an open jaw position.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A quick-action crimping tool for crimping a crimp ring on a pipe comprising:

(a) a first jaw means with a first portion of a crimp opening in a side thereof adjacent a second jaw means;

(b) a second jaw means with a second portion of a crimp opening in a side thereof adjacent the first jaw means, said second jaw means having a concave surface on a side thereof opposite the second crimp portion;

(c) a jaw constraint lever arm means having a first end and second handle end, the first jaw means being rigidly connected to the first end of the jaw constraint lever arm means, the second jaw means being pivotally connected at a first pivot point to the jaw constraint lever arm means adjacent the first jaw means so that the second jaw means can pivot about the first pivot point and thereby open and close relative to the first jaw means; and (c) a leverage arm means having a first end and a second handle end, said leverage arm means being pivotally connected to the jaw constraint lever arm means at a second point spaced from the first pivot point, the first end of the leverage arm means bearing in slidable engagement with the concave surface of the second jaw means, the concave surface being oriented so that during pivotal movement of the leverage arm means about the second pivot point relative to the jaw constraint lever arm means reciprocally moves the second jaw means into a closed position relative to the first jaw means when the leverage arm means is spaced furthest apart from said jaw constraint lever arm means.

2. A tool as claimed in claim 1 wherein the first end of the leverage arm means has thereon a rotatable wheel which contacts the concave surface of the second jaw means and rolls along the concave surface as the leverage arm means is pivotally moved about the second pivot point.

3. A tool as claimed in claim 1 wherein an extension handle is removably attached to the second end of the jaw constraint lever arm means.

4. A tool as claimed in claim 1 wherein an extension handle is removably attached to the second handle end of the leverage arm means.

5. A tool as claimed in claim 1 wherein the jaw constraint lever arm means is pivotally connected to the leverage arm means at the second pivot point by a pin and bushing.

6. A tool as claimed in claim 5 wherein the second jaw means is pivotally connected to the jaw constraint means at the first pivot point by a pin and bushing.

7. A tool as claimed in claim 2 wherein the wheel is pivotally connected to the first end of the leverage arm means by a pin and bushing.

8. A tool as claimed in claim 2 wherein the second jaw means has thereon a stop which prevents the leverage arm means from moving beyond a point where the wheel rolls out of contact with the concave surface.

9. A tool as claimed in claim 8 wherein the leverage arm means has thereon a stop which prevents the leverage arm means and the jaw constraint lever arm means from pivoting beyond a specific open position relative to each other.

10. A tool as claimed in claim 3 wherein the second handle end on the jaw constraint lever arm means has an O-ring around its circumference.

11. A tool as claimed in claim 4 wherein the second handle end of the leverage arm means has an O-ring around its circumference.

12. A tool as claimed in claim 1 wherein an end of the first jaw means opposite the jaw constraint lever means, and a corresponding end of the second jaw means opposite the jaw constraint lever means are each chamferred so as to provide a notch when the first jaw means and the second jaw means are in a closed position adjacent one another.

* * * * *